US005865068A

United States Patent [19]

Huntley

[11] Patent Number: 5,865,068

[45] Date of Patent: Feb. 2, 1999

[54] FOOT OPERATED MOTOR CONTROL

[76] Inventor: William F. Huntley, 206 Wellington Rd., Athens, Ala. 35611

[21] Appl. No.: 929,395

[22] Filed: Sep. 15, 1997

[51] Int. Cl.[6] ..... G05G 1/14

[52] U.S. Cl. ..... 74/513; 440/7; 114/153

[58] Field of Search ..... 74/560, 513, 512, 74/480 B; 114/153; 440/6, 7

[56] References Cited

U.S. PATENT DOCUMENTS 2,985,031 5/1961 Bennett ..... 74/512

3,002,398 10/1961 Beamer ..... 74/512

3,475,985 11/1969 Oldham ..... 74/512

*Primary Examiner*—Charles A. Marmor

*Assistant Examiner*—Mary Ann Battista

*Attorney, Agent, or Firm*—John C. Garvin, Jr.; James E. Staudt

[57] ABSTRACT

A foot throttle for boats wherein an eccentric is rotated by operation of a foot pedal and wherein the eccentric is biased directly against an adjustable limiter thus eliminating imprecise positioning of the throttle caused by loose tolerances in the pedal mechanism which actuates the eccentric.

10 Claims, 3 Drawing Sheets

FOOT OPERATED MOTOR CONTROL

FIELD OF THE INVENTION

This invention relates to a foot throttle for use on boats; and more particularly for use on outboard boat motors which require that the throttle cable of the motor be returned to a precise idle position upon release of actuating pressure from the throttle.

BACKGROUND OF THE INVENTION

The use of foot operated throttles for boats is well known. Such throttles have found application in many types of boats but most particularly in high performance boats such as racing boats and more recently in high speed fishing boats commonly referred to as "Bass Boats". Bass boats are typically equipped with high performance outboard motors. In the past, these motors utilized rather simple fuel systems which included the common carburetor. Throttle positions of these motors were not required to be precise since throttle movements simply rotated a butterfly type valve in the carburetor. Idle speed on motors having carburetors has typically been controlled by a throttle stop mounted on the carburetor. Modern outboard motors however include a myriad of electronic sensors which control not only complicated fuel injection systems but other critical parameters such as ignition timing. Many of these operating parameters are controlled in accordance with throttle cable positions. Examples of such motors include those designated by the trademark "FICHT" which are manufactured by the Outboard Marine Corporation (OMC). These motors differ from older motors in that they have no throttle stop within the motor itself. The motors are provided with a single lever which precisely controls the position of both the throttle and shift cables. This factory original system provides a particularly precise control of the throttle cable position when the lever is placed in the idle position. When motors of this type are used on boats which require a foot controlled throttle, the throttle cable is, of course, attached to a foot controlled throttle rather than to the original factory control. In the past, these foot controlled throttle mechanisms were not required to be precisely built and therefore, for the sake of economy, were built having loose tolerances between their moving parts. The free play resulting from these tolerances created few problems in older motors having idle stops on the motors themselves. However, serious problems result when such controls are used in conjunction with modern "FICHT" or similar type motors wherein idle settings and many other operating parameters are controlled by the precise positioning of the throttle cable rather than by idle stops within the motor. On such motors even a small variation in the idle position of the throttle cable causes misalignment of electronic sensors which control a myriad of operational parameters. Examples of unacceptable problems resulting from such misalignment include: severe variations in idle speed; rough idle; improper air emission control; improper ignition timing; improper fuel injection; improper air mixtures and the sounding of warning alarms. In addition it is noted that the loose tolerances mentioned above become more severe as normal wear occurs. These loose tolerances also prevent the throttle cable from stopping in the same position from one actuation of the throttle to the next. This lack of repeatability of the throttle cable position, when an motor is returned to idle, worsens the problems stated above.

Testing has shown that the most effective means of combating this problem is a precise and adjustable throttle stop at the foot control rather than within the motor.

Accordingly, the present invention provides a foot throttle having a unique cooperating throttle actuating and stop mechanism which effectively and inexpensively eliminates the difficulty of precise and repeatable throttle positioning particularly when the throttle is in an idle position.

SUMMARY OF THE INVENTION

This invention resolves the difficulties as mentioned above by providing a unique interaction between a throttle actuating mechanism and a throttle stop mechanism wherein precise control and repeatability of throttle position is maintained throughout the range of operation particularly when the throttle is at idle. The invention includes a foot pedal pivotally attached to a base. An eccentric is also pivotally attached to the base and is actuated by an actuator pin which is attached to the pedal and which slidably engages a slot formed in the eccentric. The eccentric is rotated about its pivotal attachment to the base in response to relative movement of the pedal actuator pin within the slot of the eccentric. A receptor mount is attached to the base and is adapted for attachment to a throttle cable. An infinitely adjustable stop means is attached to the receptor mount and is positioned for adjustable interaction between the receptor mount and the eccentric for precise limitation of the movement of the eccentric in one direction. Spring means are provided to bias the movement of the eccentric against the stop means. The receptor mount serves as a mount for the stationary (outer) sheath portion of throttle cables of the type typically used on boats. The moveable (inner) portion of these cables are adapted for attachment to the eccentric. The cables transmit the movement of the eccentric to sensors within a "FICHT" type boat motor for control thereof. A throttle limiting device is also provided between the base and the pedal for limitation of the pedal in an open throttle position. It will be noted that the tolerances between moving parts of the invention have been isolated from the mechanism which controls the final positioning of the moveable portion a throttle cable, when that portion of the cable is in the idle position. This feature is accomplished by direct attachment of the moveable portion of the throttle cable to the eccentric, and by providing a bias of the eccentric against an eccentric limiter and toward an idle position.

DETAILED DESCRIPTION OF THE INVENTION

Figure 1:
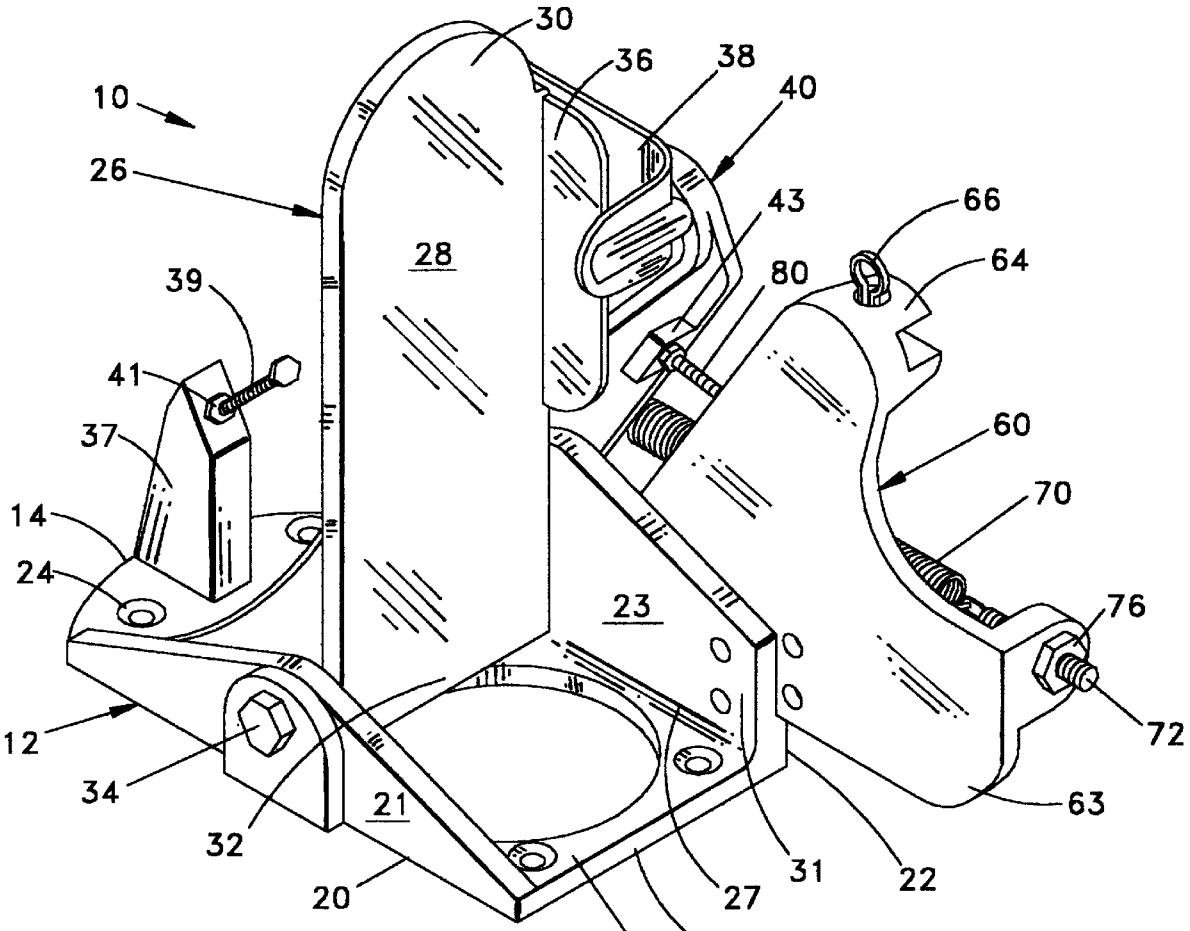
FIG. 1 is a perspective view of a foot operated throttle device which is the subject of this invention wherein the throttle device is shown in an idle position.

Referring now to FIG. 1 of the drawing, a foot operated throttle mechanism, which is the subject of this invention is illustrated generally by the numeral 10.

Figure 2:
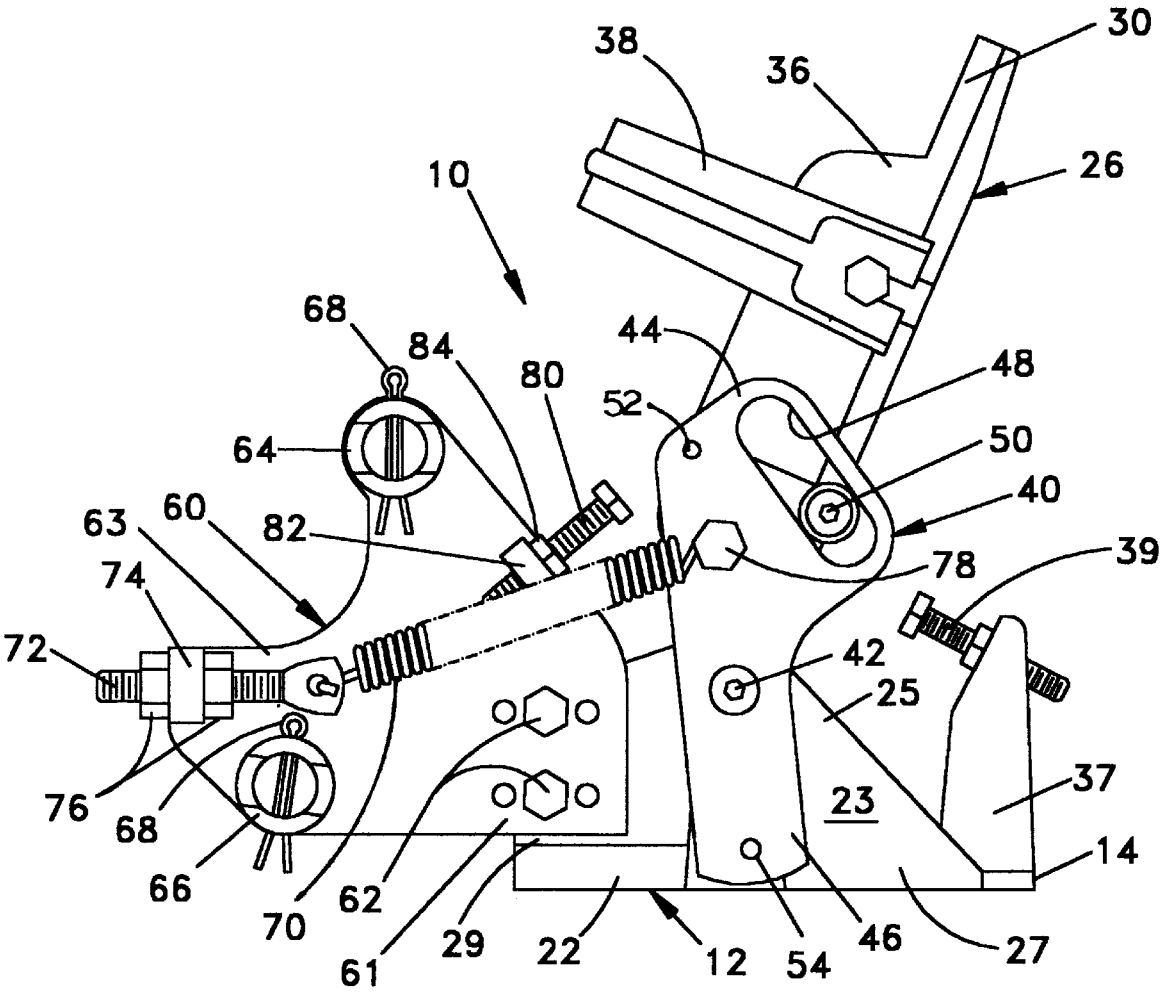
FIG. 2 is a side elevational view of the device illustrated in FIG. 1 wherein the device is shown in a partially open throttle position.
Figure 3:
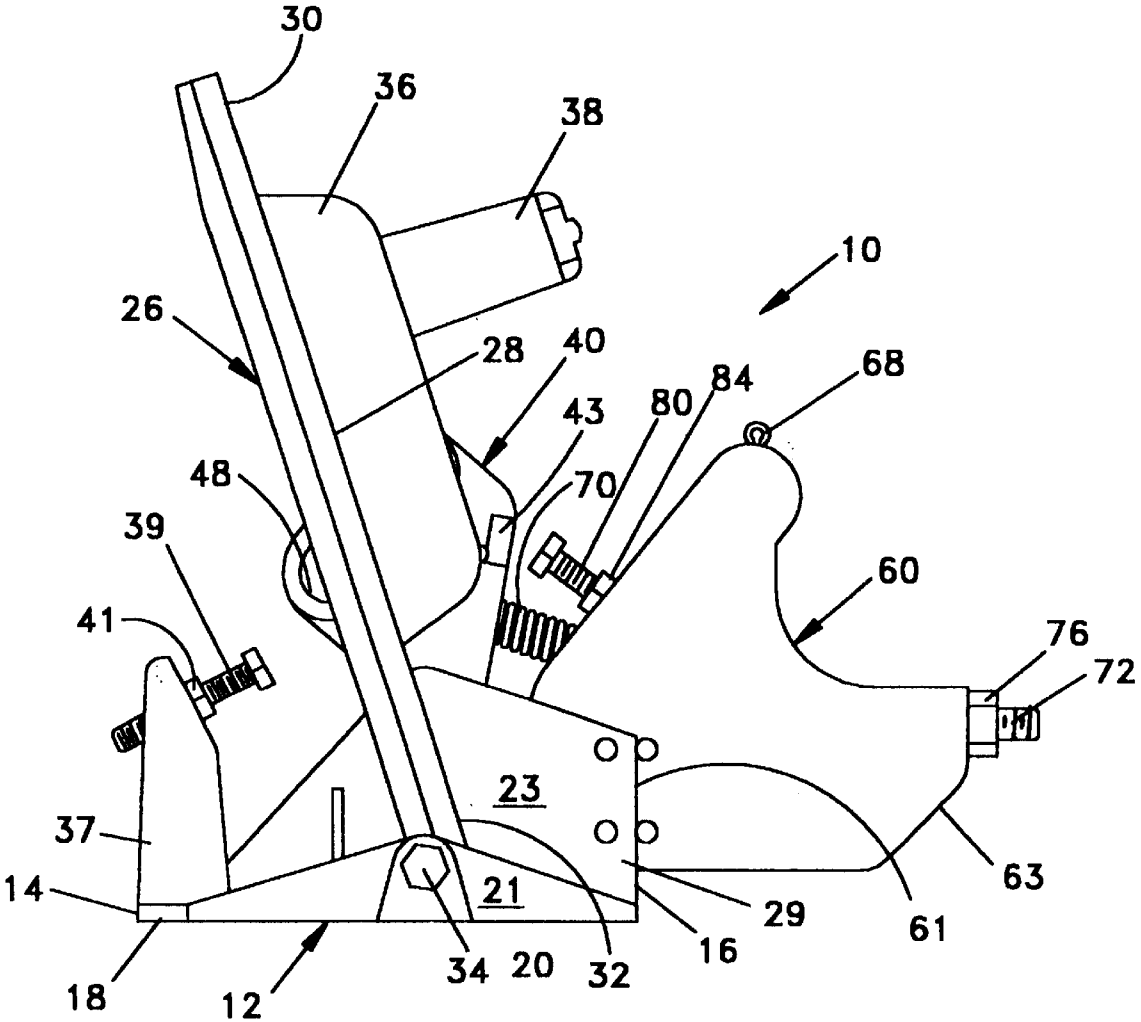
FIG. 3 is a side elevational view of the device as illustrated in FIG. 2 as viewed from the side opposite the side illustrated in FIG. 2.

A base 12 having a forward end 14 and a back end 16 includes a floor 18. A first side 20 and a second side 22 extend generally upwardly from said floor 18 so as to form a support 21 and a plate 23 respectively. The plate 23 includes an upper portion 25, a lower portion 27 and a connector portion 29. Mounting holes 24 are provided for attachment of the device 10, typically, to the deck of a boat. A pedal 26 having a face 28, a toe 30 and a heel 32 is pivotally attached to the base 12 by an axle 34 which passes through the support 21 of the base, the heel 32 of the pedal 26, and is attached to the plate 23 of the base. To aid in maintaining the foot of a user in the proper position, a foot guard 36 and a foot retainer 38 are attached to the pedal 26 adjacent the toe 30 and above the plate 23 of the base 12. A stanchion 37 extends upwardly from the floor 18 providing a mount for an adjustable pedal stop 39 which may be locked in place by a lock nut 41. The pedal stop 39 limits the forward rotation of the pedal 26. As best illustrated in FIG. 2, an eccentric 40 is pivotally attached to the plate 23 by a pivot 42. The eccentric 40 includes a top end 44 and a bottom end 46. A slot 48 is formed in the eccentric 40 and extends from the top end 44 generally downwardly and forwardly toward the forward end 14 of the base. An actuator 50 is attached to the pedal 26 intermediate the toe 30 and the heel 32. The actuator 50 is positioned within the slot 48 for rotation of the eccentric 40 about pivot 42 in response to rotation of the pedal 26 about axle 34. The eccentric 40 is provided with a limiter block 43 (best illustrated in (FIGS. 1 and 3). A pull connector 52 and a push connector 54, are formed adjacent the top end 44 and the bottom end 46 respectively of the eccentric. Each of the connectors consist of a threaded hole which serves as a connector for attachment of the inner(movable) portion of a throttle cable (not shown) to the eccentric 40. As is apparent from the drawing the pull connector 52 actuates the moveable portion of a throttle cable by a pulling motion of the eccentric while the converse is true of the push connector. It is noted that most applications utilize the pull type system. The function of the push pull connectors will be discussed in more detail hereinafter. A receptor mount 60 is attached by mounting bolts 62 to the connector portion 29 of plate 23. The receptor mount 60 has a forward section 61 and a rear section 63. The receptor mount 60 also includes a pull receptor 64 which is in general horizontal alignment with the pull connector 52, and a push receptor 66 which is in general horizontal alignment with the push connector 54. These receptors are configured for reception of barrel shaped connectors which are commonly used for mounting the stationary outer sheaths of throttle cables such as are used in modern boats. These connectors are typically held in place by cotter pins such as 68. This arrangement permits limited rotation of the barrel connectors in receptors such as 64 and 66. This limited rotation prevents bending of the throttle cable as the end of the inner (moveable) portion of the cable moves a small amount in a vertical direction. As will be noted in FIG. 2, the connectors 52 and 54 do move vertically, to some degree, as the eccentric 40 rotates about the pivot 42. A spring 70 is adjustably connected at one end to the rear section 63 of receptor mount 60 by a spring adjuster 72. The spring adjuster 72 is threadedly attached to an internally threaded spring mount 74. The spring adjuster 72 is locked to prevent rotation by a spring lock nuts 76. The distal end of the spring 70 is attached to the eccentric 40 by a spring bolt 78. An eccentric limiter 80 is attached to the forward section of receptor mount 60 by an internally threaded limiter mount 82. A limiter lock nut 84 is provided for locking the limiter 80 in a desired position. As best illustrated in FIG. 1, it will be noted that the spring 70 retains the limiter block 43 of the eccentric 40 solidly against the eccentric limiter 80 when the throttle pedal has been released by the operator. It will be noted that FIGS. 2 and 3 illustrate the device in a partly open throttle position wherein contact is not made between eccentric limiter 80 and the limiter block 43. Of great importance to the effectiveness of this device is its ability to maintain a precise, repeatable throttle cable position when the throttle is in an idle or released position. It will be noted that a direct spring connection between the receptor mount 60 and the eccentric 40 is utilized in this invention. This arrangement eliminates the problem of loose tolerances anywhere in the linkage. For example, it will be clear that the tolerances between the pedal and its axle and/or between the actuator 50 and the slot 48 of the eccentric 40 will have no effect whatever on the precise positioning of the eccentric when the device is in the idle position.

I claim:

1. A foot operated throttle control comprising:

a base having a forward end and a back end;

an eccentric pivotally attached to said base and adapted for connection to a throttle cable;

a pedal mechanism pivotally attached to said base, slidably attached to said eccentric and disposed for pivotal actuation of said eccentric in response to rotation of said pedal mechanism;

a receptor mount attached adjacent said back end to said base;

bias means attached between said eccentric and said receptor mount for biasing said eccentric toward said receptor mount;

an eccentric limiter attached to said receptor mount and adapted for contact with said eccentric so as to limit the rotation of said eccentric toward said receptor mount.

2. A foot operated throttle control as set forth in claim 1 wherein said pedal mechanism includes a pedal having a heel and a toe and an actuator attached intermediate said heel and said toe for actuation of said eccentric, and wherein said pedal is pivotally attached to said base, adjacent said heel.

3. A foot operated throttle control as set forth in claim 2 wherein said eccentric includes a top end, a bottom end and a slot extending from said top end generally toward the forward end of said base and disposed for slidable engagement with said actuator.

4. A foot operated throttle control as set forth in claim 3 wherein said eccentric is pivotally attached to said base generally intermediate said top end and said bottom end of said eccentric.

5. A foot operated throttle control as set forth in claim 4 wherein said bias means includes a spring adjustably attached at one end thereof to said receptor mount and at the distal end thereof to said eccentric.

6. A foot operated throttle control as set forth in claim 5 wherein said eccentric includes a pull connector adjacent said top end and a push connector adjacent said bottom end, each of said connectors being disposed for attachment to said throttle cable.

7. A foot operated throttle control as set forth in claim 6 wherein said base includes a first side having a support extending upwardly therefrom, a second side having a plate extending upwardly therefrom, said plate having a lower portion, an upper portion and a connector portion, wherein said receptor mount includes a forward section attached to said connector portion, and a rear section, wherein said eccentric is pivotally connected to said base adjacent said upper portion of said plate, and wherein said spring is attached to the rear section of said receptor mount.

8. A foot operated throttle control as set forth in claim 7 wherein said receptor mount further includes a pull receptor generally aligned horizontally with said pull connector of said eccentric, and a push receptor generally horizontally aligned with said push connector of said eccentric.

9. A foot operated throttle control as set forth in claim 8 wherein said base further includes a stanchion extending generally upwardly from the forward end of said base, and a pedal stop means extending generally toward said pedal for limiting the forward rotation of said pedal, and wherein said eccentric limiter is adjustably attached to the forward section of said receptor mount and contacts the eccentric in general proximity of said pull connector so as to provide a positive limiting rotation of the eccentric when the pull connector of the eccentric is moved toward the pull receptor of the receptor mount by said spring.

10. A foot operated motor control comprising:

a base including a floor, said floor having a forward end, a back end, a first side, a second side, a support extending upwardly from said first side, and a plate extending upwardly from said second side, said plate having an upper portion a lower portion and a connector portion;

a shaft interconnecting said support to said plate in close proximity to said floor;

a pedal having a heel pivotally connected to said shaft, a toe, and an intermediate portion between said heel and said toe;

a pivot attached to the upper portion of said plate;

an eccentric having a top end, a bottom end and a slot extending from said top end generally downwardly and forwardly toward the forward end of said base, said eccentric pivotally attached at said pivot;

an actuator pin attached to said pedal and slidably positioned within said slot whereby said eccentric is rotated about said pivot in response to pivotal movement of said pedal about said shaft;

a receptor mount having forward section, a rearward section, pull receptor and a push receptor, said forward section attached to the connector portion of said plate;

bias means attached between the rearward section of said receptor mount and said eccentric so as to bias said eccentric toward said receptor mount; and adjustable limiter means attached adjacent the forward section of said receptor mount and aligned for contact with said eccentric so as to limit the movement of said eccentric in a direction toward said receptor mount.

* * * * *